United States Patent [19]

Laveran et al.

[11] Patent Number: 4,903,763

[45] Date of Patent: Feb. 27, 1990

[54] FINNED TUBE EVAPORATOR WITH COLLECTOR ASSEMBLY FOR JOINING PLURAL TUBE OUTLETS TO SECTION LINE WITH MINIMUM TURBULENCE

[75] Inventors: Jean-Louis Laveran, Asnieres; Gérard Poitier, Gennevilliers; Patrice Leblond, Laval, all of France

[73] Assignee: Valeo, Paris, France

[21] Appl. No.: 302,268

[22] Filed: Jan. 27, 1989

[30] Foreign Application Priority Data

Jan. 28, 1988 [FR] France ..... 88 00962

[51] Int. Cl.[4] ..... F28F 9/02; F25B 39/02

[52] U.S. Cl. ..... 165/175; 62/525

[58] Field of Search ..... 165/110, 175, 173; 62/504, 525; 137/602

[56] References Cited

U.S. PATENT DOCUMENTS

| | | | |
|---|---|---|---|
| 2,088,254 | 7/1937 | Wolfert . | |
| 2,220,831 | 11/1940 | Swart . | |
| 2,787,138 | 4/1957 | Boyle . | |
| 2,791,107 | 5/1957 | Malkoff | 62/525 X |
| 3,745,787 | 7/1973 | Ponziani . | |
| 4,690,209 | 9/1987 | Martin . | |

FOREIGN PATENT DOCUMENTS

| | | |
|---|---|---|
| 919401 | 3/1947 | France . |
| 777661 | 6/1957 | United Kingdom . |

*Primary Examiner*—Alan Cohan

*Attorney, Agent, or Firm*—Dennison, Meserole, Pollack & Scheiner

[57] ABSTRACT

The present invention relates to a heat exchanger for changing the state of a fluid, for example an evaporator (1) for the fluid used in an air conditioning apparatus, the heat exchanger comprising tubular circuits (4) extending through fins (5), a distributor assembly for the fluid in a first state, connecting a fluid delivery tube to the input ends (6) of the said tubular circuits (4), and a collector assembly for collecting the fluid in a second state, the collector assembly being disposed so as to connect the outlet ends (8) of the tubular circuits (4) to a suction tube (10) and comprising a cylindrical part (11) arranged to form a coaxial extension of the suction tube (10) and being of larger radius than the suction tube.

The invention is especially applicable to automotive vehicles.

9 Claims, 2 Drawing Sheets

FINNED TUBE EVAPORATOR WITH COLLECTOR ASSEMBLY FOR JOINING PLURAL TUBE OUTLETS TO SECTION LINE WITH MINIMUM TURBULENCE

FIELD OF THE INVENTION

The present invention is concerned with a heat exchanger for changing the state of a fluid, for example an evaporator for an air conditioning installation, especially for automotive vehicles.

BACKGROUND OF THE INVENTION

An evaporator or a condenser commonly includes a multiplicity of tubular circuits, formed from a series of parallel U tubes connected to each other through bent tube sections in such a way as to provide a serpentine path in each tubular circuit, with fins through which these circuits pass. The fins are substantially parallel to the tubes and are in heat conductive contact with them. The conventional evaporator or condenser also has a fluid distributor assembly connected to one end of the said circuits and a fluid collector assembly connected to their other end. The fluid is for example a refrigerant fluid of the fluorocarbon type.

In addition, in such an evaporator, the tubular circuits are disposed in such a manner that the segments of the parallel U tubes which form part of the said circuits are grouped in an arrangement which is such that the said segments are either juxtaposed to each other or superimposed upon each other. This arrangement is necessary in order to obtain the required change of state of the refrigerant fluid in the tubular circuits such that, after heat exchange with another fluid such as ambient air passed through the evaporator, the refrigerant fluid reaches the outlet ends of the tubular circuits in a second state changed from the initial state in which it was introduced into the evaporator.

To this end, the fluid distributor assembly commonly includes a delivery tube which is connected through narrow or capillary tubes to the input ends of the tubular circuits, in such a way that the fluid is then distributed in substantially equal quantities to each circuit.

Conventionally, the fluid is removed from the evaporator by collecting means which comprises a hollow collecting cylinder closed at its ends, with a general axis which is perpendicular to the outlet ends of the circuits. The circumferential wall of the collecting cylinder is formed with bores in which the outlet ends of the tubular circuits are sealingly fixed, together with another bore in which a suction tube, for removal of the fluid, is also sealingly fixed. Such an arrangement is described in U.S. Pat. No. 2 088 254.

Certain disadvantages have been found to exist in this conventional fluid collecting means when used for removing the fluid from an evaporator or condenser in a vehicle. The fluid arriving in liquid form at the input ends of the tubular circuits leaves in the form of a gas via the outlet end of the said circuits, and enters the hollow collecting cylinder at a high velocity, so that when it impinges on the internal wall surface of the latter, noise and vibrations are set up which can be transmitted back through the evaporator. Since the evaporator is arranged close to the interior or passenger compartment of the vehicle, these noises and vibrations can thereby be transmitted into the passenger compartment.

In addition, conventional fluid collectors waste energy in the fluid, thus creating a loss of pressure and, in extreme cases, involving the danger that the change of state of the fluid may not be complete at the outlet end of the evaporator circuits, so that there can then be a mixture of the fluid in different states. Such a mixture at this stage is inadmissible.

SUMMARY OF THE INVENTION

An object of the present invention is to overcome the above mentioned disadvantages. To this end, the invention proposes to provide an evaporator having a fluid collector assembly which is of simple construction, economical to produce and which nevertheless allows the performance of the evaporator to be maximized.

According to the invention, there is provided a heat exchanger for changing the state of a fluid, for example an evaporator for the fluid used in an air conditioning apparatus for an automotive vehicle, the heat exchanger comprising tubular circuits extending through fins, and a distributor assembly for the fluid in a first state, connecting a fluid delivery tube to the input ends of the said tubular circuits, the heat exchanger further comprising a collector assembly for collecting the fluid in a second state, the collector assembly being so disposed as to connect the outlet ends of the tubular circuits with a suction tube, the heat exchanger being characterised in that the collector assembly comprises a cylindrical part forming a coaxial extension of the suction tube and being of larger radius than the suction tube.

The arrangement whereby the collector assembly is disposed as an extension of the suction tube enables energy losses in the fluid leaving the tubular circuits, and passing to the suction tube, to be substantially avoided.

According to another feature of the invention, the cylindrical part has a first end face and a second end face opposed to each other with the first end face proximal to the suction tube and with bores formed through the second end face, the heat exchanger comprising means joining the said bores to the outlet ends of the tubular circuits, and the cylindrical part including means bringing the said bores into communication with the suction tube.

According to a further feature of the invention, the axis of each of the said bores is substantially parallel with that of the cylindrical part.

In some embodiments of the invention, each of the said bores has at its inner end a conical portion which is convergent towards the said first end face.

The features mentioned above enable the fluid to avoid impinging against a cylindrical surface. Instead, the direction of flow of the fluid in the collector assembly is partly that of the suction tube itself, and partly diverted towards the latter by the conical portions.

The cylindrical part of the collector assembly may include a tubular portion. In that case, preferably, the said cylindrical part is of greater diameter than the suction tube, and includes a frusto conical portion interposed between the said tubular portion and the suction tube.

The tubular and conical portions together enable a collector assembly to be made in a very simple and inexpensive form.

Other features and advantages of the invention will appear more clearly from the description of preferred embodiments which follows, and which is given by way of example only and with reference to the accompanying drawings.

DESCRIPTION OF PREFERRED EMBODIMENTS

Figure 1:
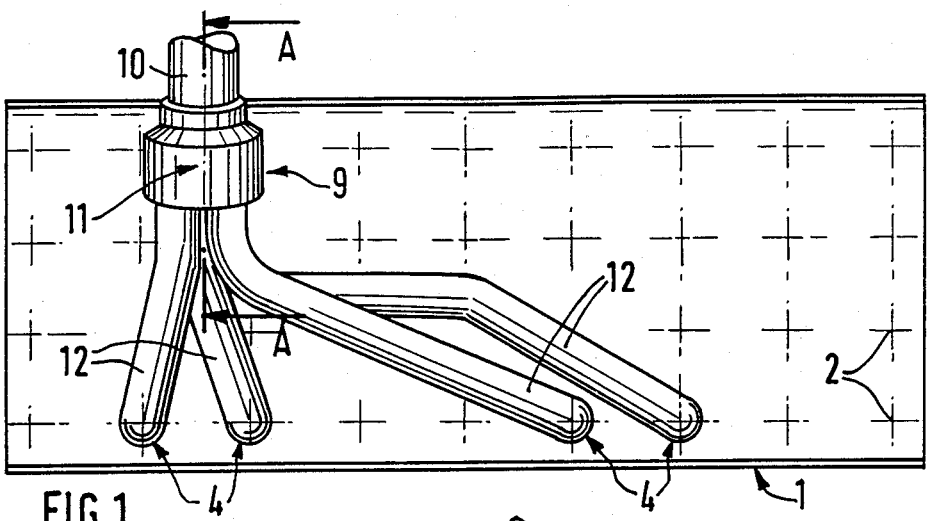
FIG. 1 is a view in elevation showing a heat exchanger including the collector assembly according to the invention.
Figure 2:
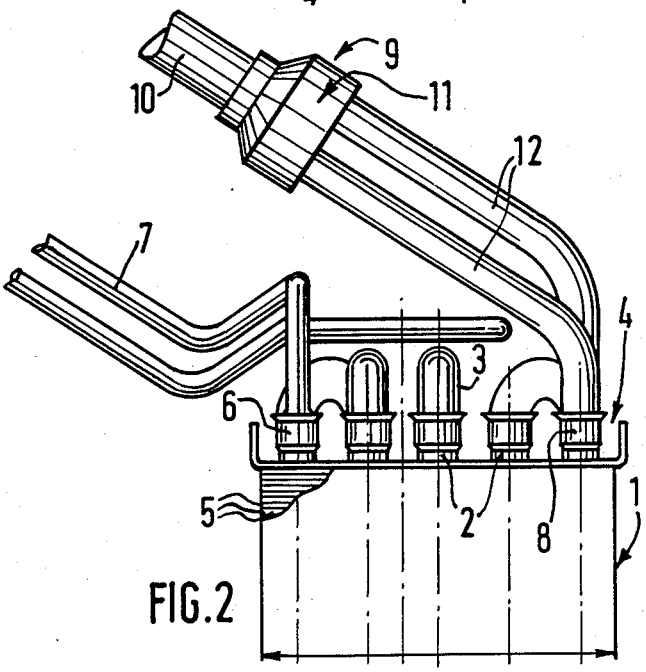
FIG. 2 is side view of the apparatus shown in FIG. 1.

Referring to FIGS. 1 and 2, in this example the heat exchanger, shown at 1, is an evaporator for changing the state of a refrigerant fluid, such as a fluorocarbon, flowing through it. The heat exchanger 1 comprises a series of U tubes 2, which are parallel to each other and which are connected by bent tube sections 3 so as to form a tubular or serpentine circuit indicated generally at 4. The heat exchanger also has fins 5, which are traversed by at least two of the tubular circuits 4, and in this example by four of these circuits. The fins 5 are substantially perpendicular to the tubes and are in heat conducting contact with them. Each circuit 4 has an inlet end 6 for admission of the refrigerant fluid in its initial state through distributing means, not entirely shown in the drawings but including a delivery tube leading to narrow or capillary tubes 7 which are connected to the inlet ends 6. Each circuit 4 also has an outlet end 8 for evacuation of the fluid, after its state has been changed, towards a suction tube 10.

As can readily be seen from the drawings, the collector assembly 9 is formed as an extension of the suction tube 10 and comprises a cylindrical part generally indicated at 11, of greater radius than the suction tube and arranged coaxially with it.

In the example shown, the collector assembly 9 connects the outlet ends of the circuits 4 to the suction tube 10 through tubes 12 which are sealingly fitted to the outlet ends 8.

Figure 3:
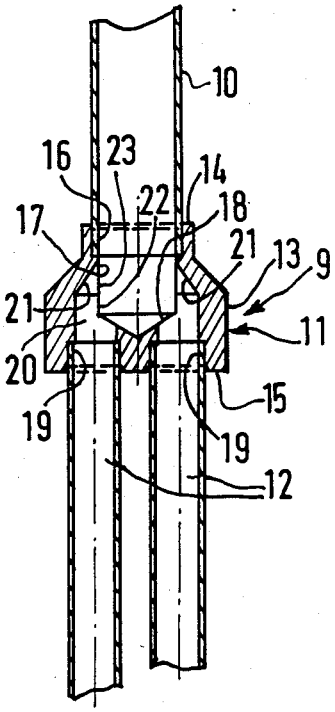
FIG. 3 is a view in cross-section, on a larger scale, showing part of the collector assembly, the section being taken on the line A—A in FIG. 1.
Figure 4:
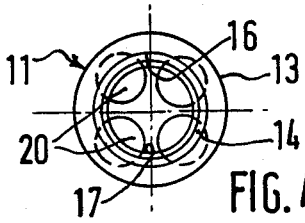
FIG. 4 is a partial view in elevation of the collector assembly according to the invention.

FIGS. 3 and 4 show an embodiment of the invention in which the cylindrical part 11 comprises a cylindrical member 13, having first and second opposed, parallel end faces 14 and 15, which are adapted to receive respectively the suction tube 10 and the tubes 12 connected to the outlet ends 8, so as to bring the tubes 12 into communication with the suction tube.

The member 13 has a first bore 16 extending from its end face 14. The depth and diameter of the bore 16 are adapted to receive the suction tube 10 coaxially, so that it can be sealingly fixed in the bore 16. The first bore 16 leads into a second bore 17, the diameter of which is substantially equal to the internal diameter of the suction tube 10. The inner end 18 of the bore 17 is of conical form resulting from the boring operation, and is spaced axially from the second end face 15 of the member 13.

The end face 15 is formed with at least two identical bores 19, which are situated, circumferentially and radially, at equal distances from the axis of the bore 17. The dimensions of the bores 19 are adapted so that they can receive respective tubes 12, so that the latter are sealingly fixed in the bores. The bores 19 lead into further bores 20, each having a diameter substantially equal to the internal diameter of a tube 12 and having at its inner end a conical portion 21 which is convergent towards the end face 14.

In addition, the diameter of the bore 17 is in practice substantially equal to the sum of the diameters of the bores 20.

The bores 20, including their conical portions 21, which receive fluid from the tubes 12, are situated circumferentially and radially with respect to the axis of the bore 17, in such a way that the bores 20 proper, together with the conical portions 21, open partially into the bore 17 through ports 22 and 23. The ports 22 and 23 are respectively formed by the partial intersection of the bores 20 with the bore 17 and its inner end portion 18, and by the partial intersection of the conical portions 21 with the bore 17.

In operation with this configuration, the fluid in generally gaseous form (after having its state changed in the evaporator) arrives at the input end of the collector assembly and flows into the bores 20. From there it passes into the bore 17, partly through the ports 22 and partly by deviation through the conical portions 21 and thence through the ports 23.

Thus a part of the fluid is directed towards the suction tube 10 without having to negotiate a long or devious route, thus beneficially reducing energy losses in the fluid. The remainder of the fluid passes into the collector assembly 9 without encountering a perpendicular wall in the direction of flow. Instead it impinges on walls which are inclined with respect to the direction of flow and which merely divert the flow towards the ports 23. This diversion is caused by the conical portions 21, thus reducing the noise which usually occurs in fluid passing through a collector assembly.

Figure 5:
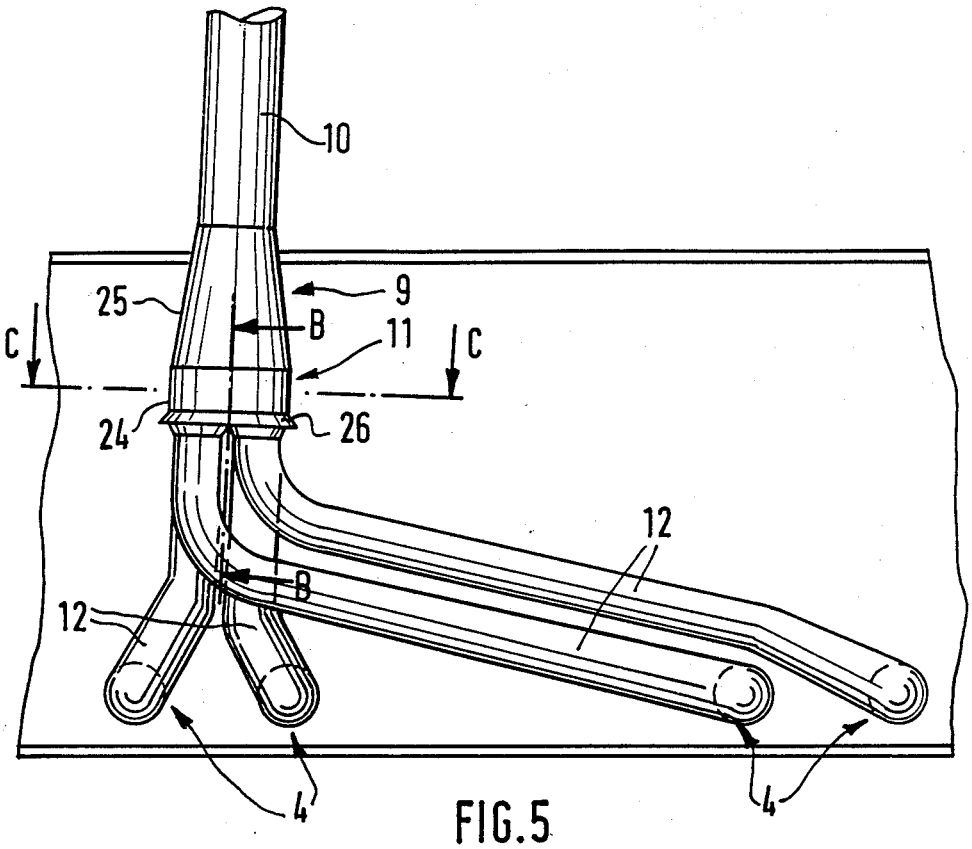
FIG. 5 is a view in elevation, showing a heat exchanger with a modified form of the collector assembly according to the invention.

FIG. 5 shows a modified embodiment of the collector assembly 9, in which the cylindrical part 11, again of larger radius than the suction tube 10 and coaxial with it, comprises a tubular portion 24 which is connected with the suction tube 10 by a frusto conical tubular portion 25, the function of which is substantially identical to that of the conical portions 21 described above.

The tube portions 24 and 25 are preferably formed as a direct extension of the suction tube 10, using a swaging process which enables a further frusto conical portion 26 to be formed in addition to the portions 24 and 25. The purpose of the portion 26 will be described below.

Figure 6:
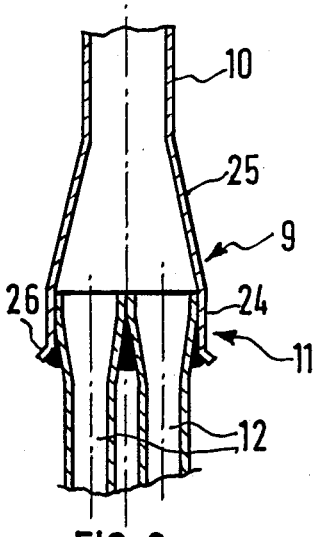
FIG. 6 is a view in cross-section, taken on the line B—B in FIG. 5.

As is best seen in FIGS. 5 and 6, the portion 24 is adapted to receive the end portions of the tubes 12, which are again connected to the outlet ends 8 of the tubular circuits 4, with the end portions of the tubes 12 sealingly fixed in the portion 24, in such a way that the axes of these tube end portions are parallel with the axis of the portion 24. For this purpose, the end portions of the tubes 12 are grouped in a pattern whereby each one is in peripheral contact with the outer surface of two other tube end portions.

In the example described above, the configuration of the end portions of each of the four tubes 12 is such that the two planes which contain the longitudinal axis of that tube end portion and the longitudinal axis of each of those in contact with it, are substantially orthogonal to each other.

The end portions of the tubes 12, grouped in this way, are presented endwise to the tubular cylindrical portion 24, and, guided by the conical portion 26, are then introduced into the cylindrical portion 24 until they make contact with the internal wall of the conical portion 25. Once this position has been reached, it is only necessary to introduce, into the space left free between the internal wall of the tubular portion 24 and the outer wall of the end portion of each tube 12, a material suitable to form a sealed joint between the various components. This material may for example be introduced by brazing.

Figure 7:
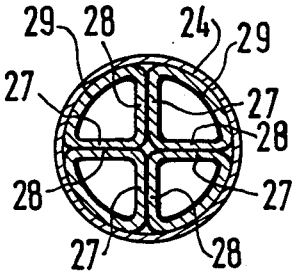
FIG. 7 is a view in cross-section, taken on the line C—C in FIG. 5.
Figure 8:
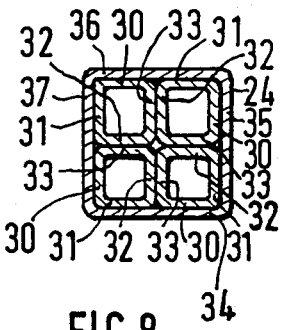
FIG. 8 is a view in cross-section showing a modification of the collector assembly seen in FIG. 7.

FIGS. 7 and 8 show preferred configurations which minimise the amount of joining and sealing material necessary. Referring to these Figures, the end portions of the tubes 12 are so shaped that, with the outer wall surface of each end portion in circumferential contact with the outer wall surfaces of two other end portions, the space left free between the inner wall of the portion 24 and the outer wall of each tube 12 is reduced to a minimum.

Thus, as seen for example in FIG. 7, the end portions of the tubes 12, introduced into the tubular portion 24, are deformed so as to give, in cross-section, two flat, perpendicular wall portions 27 and 28, each substantially equal in length to the internal radius of the tubular portion 24. In each tube end portion, wall portions 27 and 28 are joined together at one end, their other ends being joined together by a wall portion 29 of arcuate cross-section, having an external radius which is also substantially equal to the internal radius of the tubular portion 24.

The flat wall portions 27 and 28 of an end portion of a tube 12 thus make close, substantially planar, contact with, in each case, one of the wall portions 28 or 27 respectively of two other end portions of tubes 12, while the arcuate wall portion 29 is similarly in close contact with the internal wall surface of the tubular portion 24. The various components and their wall portions are thus joined together in a secure and sealed manner.

In the modified configuration shown in FIG. 8, the tubular portion 24 is polygonal in cross-section, being in this example square with sides 34, 35, 36 and 37 in parallel pairs, for receiving the end portions of the tubes 12. As will be clear from the Figure, the end portions of the tubes 12 have a similar shape in cross-section to the tubular portion 24, comprising flat wall portions 30, 31, 32 and 33 arranged in parallel pairs so as to form a square. The flat wall portions 32 and 33 are in substantially planar contact with respective ones of the flat wall portions 33 or 32 of two other end portions of tubes 12, while the wall portions 30 and 31 are in substantially planar contact with respective ones of the flat wall portions 34 or 35 or 36 or 37 of the tubular portion 24. As described above, it is only necessary to fit together the various walls to obtain a secure and fluid-tight joint.

The invention is not limited to the embodiments described, but embraces any modification. For example, the shape of the tubular cylindrical portion 24 may be different from that described: it may for example be hexagonal. In this case, the end portions of the tubes 12 may be made in a shape which is similar to or different from that of the portion 24. Alternatively the end portions of the tubes 12 may, wholly or partly, be shaped differently from each other, for example square and triangular, or square and hexagonal, in such a way as to occupy the maximum possible internal volume of the cylindrical portion 24.

What is claimed is:

1. (amended) A heat exchanger for changing the state of a fluid, for example an evaporator for the fluid used in an air conditioning apparatus for an automotive vehicle, the heat exchanger comprising tubular circuits extending through fins, and a distributor assembly for the fluid in a first state, connecting a fluid delivery tube to the input ends of the said tubular circuits, the heat exchanger further comprising a collector assembly for collecting the fluid in a second state, the collector assembly being so disposed as to connect the outlet ends of the tubular circuits with a suction tube, the heat exchanger being characterized in that the collector assembly comprises a cylindrical part forming a coaxial extension of the suction tube and being of larger radius than the suction tube and wherein the cylindrical part has a first end face and a second end face opposed to each other with the first end face proximal to the suction tube and with bores formed through the second end face, the heat exchanger comprising means joining the said bores to the outlet ends of the tubular circuits, and the cylindrical part including means bringing the said bores into communication with the suction tube.

2. A heat exchanger according to claim 1, wherein the axis of each of the said bores is substantially parallel with that of the cylindrical part.

3. A heat exchanger according to claim 1, wherein each of the said bores has at its inner end a conical portion which is convergent towards the said first end face.

4. A heat exchanger according to claim 1, wherein the said bores are disposed, radially and circumferentially, equidistantly from each other with respect to the axis of the cylindrical part.

5. A heat exchanger for changing the state of a fluid, for example an evaporator for the fluid used in an air conditioning apparatus for an automotive vehicle, the heat exchanger comprising tubular circuits extending through fins, and a distributor assembly for the fluid in a first state, connecting a fluid delivery tube to the input ends of the said tubular circuits, the heat exchanger further comprising a collector assembly for collecting the fluid in a second state, the collector assembly being so disposed as to connect the outlet ends of the tubular circuits with a suction tube, the heat exchanger being characterized in that the collector assembly comprises a cylindrical part having a tubular portion forming a coaxial extension of the suction tube and being of larger radius than the suction tube and wherein said outlet ends of said tubular circuits are received in the tubular portion of the cylindrical part, the said outlet ends having end portions so shaped as to fit together, each said end portion having two flat wall portions perpendicular to each other at one end and connected together at their other ends by an arcuate wall portion.

6. A heat exchanger according to claim 5, wherein the said cylindrical part is of greater diameter than the suction tube, and includes a frusto conical portion interposed between the said tubular portion and the suction tube.

7. A heat exchanger for changing the state of a fluid, for example an evaporator for the fluid used in an air conditioning apparatus for an automotive vehicle, the heat exchanger comprising tubular circuits extending through fins, and a distributor assembly for the fluid in a first state, connecting a fluid delivery tube to the input ends of the said tubular circuits, the heat exchanger further comprising a collector assembly for collecting the fluid in a second state, the collector assembly being so disposed as to connect the outlet ends of the tubular circuits with a suction tube, the heat exchanger being characterized in that the collector assembly comprises a cylindrical part having a tubular portion polygonal in cross section forming a coaxial extension of the suction tube and being of larger cross sectional area than the suction tube and wherein said outlet ends of said tubular circuits are received in the polygonal tubular portion of the cylindrical part, the said outlet ends having end portions so shaped as to fit together with minimum interstices, each said end portion having at least one flat wall.

8. A heat exchanger according to claim 7, wherein the end portions of the said outlet ends are polygonal in cross section.

9. A heat exchanger according to claim 8 wherein the end portions of the said outlet ends are square in cross section.

* * * * *